US006827470B2

(12) United States Patent
Sagal et al.

(10) Patent No.: US 6,827,470 B2
(45) Date of Patent: Dec. 7, 2004

(54) THERMALLY CONDUCTIVE LAMP REFLECTOR

(75) Inventors: E. Mikhail Sagal, Warwick, RI (US); Kevin A. McCullough, N. Kingstown, RI (US); James D. Miller, Marietta, GA (US)

(73) Assignee: Cool Optins, Inc., Warwick, RI (US)

( * ) Notice: Subject to any disclaimer, the term of this patent is extended or adjusted under 35 U.S.C. 154(b) by 0 days.

(21) Appl. No.: 10/229,557

(22) Filed: Aug. 28, 2002

(65) Prior Publication Data

US 2003/0043586 A1 Mar. 6, 2003

Related U.S. Application Data

(60) Provisional application No. 60/316,485, filed on Aug. 31, 2001.

(51) Int. Cl.[7] ..... F21V 7/00

(52) U.S. Cl. ..... 362/341; 362/255; 362/256; 362/373; 362/294; 362/345; 362/296; 524/404

(58) Field of Search ..... 362/341, 255, 362/256, 373, 294, 345, 296; 524/404

(56) References Cited

U.S. PATENT DOCUMENTS

| | | | | |
|---|---|---|---|---|
| 3,852,583 A | | 12/1974 | Puyplat | 240/41.35 R |
| 4,115,177 A | | 9/1978 | Nelson | |
| 4,188,358 A | | 2/1980 | Withoos et al. | |
| 4,364,637 A | | 12/1982 | Ohno et al. | 350/288 |
| 4,507,254 A | | 3/1985 | Daniels et al. | 264/1.9 |
| 4,570,203 A | | 2/1986 | Daniels et al. | 362/16 |
| 4,617,618 A | | 10/1986 | Baciu et al. | 362/341 |
| 4,670,199 A | | 6/1987 | Montet et al. | 264/1.9 |
| 4,807,969 A | | 2/1989 | Shimodaira et al. | 350/320 |
| 4,875,766 A | | 10/1989 | Shimodaira et al. | 350/641 |
| 4,931,227 A | | 6/1990 | Nakahashi et al. | 264/1.9 |
| 5,177,396 A | | 1/1993 | Gielen et al. | 313/113 |
| 5,178,709 A | | 1/1993 | Shimodaira et al. | 156/242 |
| 5,275,764 A | | 1/1994 | Hettinga | 264/1.9 |
| 5,865,530 A | * | 2/1999 | Weber | 362/341 |
| 5,895,302 A | | 4/1999 | Chen-Lun et al. | 445/23 |
| 5,916,496 A | | 6/1999 | Weber | |
| 5,945,775 A | | 8/1999 | Ikeda et al. | 313/113 |
| 6,048,919 A | | 4/2000 | McCullough | |
| 6,210,619 B1 | | 4/2001 | Owens | 264/255 |
| 6,251,978 B1 | | 6/2001 | McCullough | |
| 6,356,376 B1 | * | 3/2002 | Tonar et al. | 359/267 |
| 6,458,428 B2 | | 10/2002 | Inaba | 427/491 |
| 6,710,109 B2 | * | 3/2004 | McCullough et al. | 524/404 |

FOREIGN PATENT DOCUMENTS

| | | | | |
|---|---|---|---|---|
| FR | 0267848 | * | 6/1986 | G02B/5/08 |

* cited by examiner

*Primary Examiner*—Stephen Husar
*Assistant Examiner*—Bertrand Zeade
(74) *Attorney, Agent, or Firm*—Barlow, Josephs & Holmes, Ltd.

(57) ABSTRACT

A thermally conductive lamp reflector is provided that dissipates heat from a light source within the reflector. The reflector assembly includes a shell having a metallized layer on its surface. The shell is made from a composition including about 30% to about 80% by volume of a base polymer matrix and about 20% to about 70% by volume of a thermally conductive filler material. The reflector has a thermal conductivity of greater than 3 W/m° K and preferably greater than 22 W/m° K. The reflectors can be used in automotive headlamps, flashlights, and other lighting fixtures. A method of forming the lamp reflector is also provided.

10 Claims, 2 Drawing Sheets

THERMALLY CONDUCTIVE LAMP REFLECTOR

CROSS-REFERENCE TO RELATED APPLICATIONS

This application claims the benefit of U.S. provisional application No. 60/316,485 having a filing date of Aug. 31, 2001.

BACKGROUND OF THE INVENTION

The present invention generally relates to lamp reflectors and methods for making such reflectors. Particularly, the reflectors are made from a thermally conductive polymer composition that can dissipate heat from a heat-generating light source within the reflector. The reflectors can be used in automotive headlamps, flashlights, and other lighting fixtures.

In the past, reflector housings for automotive headlamps and other lighting devices were made by stamping sheets of metal into a desired shape. A layer of aluminum was vacuum-deposited onto the shaped metal to form a highly polished reflective surface. This metal stamping process produced headlamps having good mechanical strength, but only a limited number of simple shapes could be made. As designs for automobile headlights changed, the need for reflectors having more complex aerodynamic structures grew.

Today, reflector housings for automotive headlamps are often made from thermosetting or thermoplastic compositions that can be molded into a variety of shapes. Typically, these compositions contain a resin and a reinforcing material that improves the strength and dimensional stability of the molded housing.

For example, Weber, U.S. Pat. No. 5,916,496 discloses a method of molding a vehicle lamp reflector from a composition containing substantial amounts of fiber and mineral fillers. The method produces a lamp reflector having a substantially organic skin over a substantially inorganic core. A layer of aluminum can be vacuum-deposited onto the organic skin without using a base coat.

Baciu et al., U.S. Pat. No. 4,617,618 discloses a headlamp reflector made by a co-injection molding process. The core of the reflector is made from a composition containing polyalkylene terephthalate and hematite (85 to 95% by weight of $Fe_2O_3$) particles having a particle size less than 70 $\mu$m. Glass fibers, microbeads, and other filler materials can be added to the composition.

Withoos et al., U.S. Pat. No. 4,188,358 disclose a method of manufacturing a metallized plastic reflector. A film or fabric of fibrous material (for example, glass or carbon fibers) is provided over a convex surface of a mold and saturated with a thermo-hardening synthetic resin. After partial hardening of the resin, a layer of liquid metal particles is sprayed onto the resin. A supporting layer including a synthetic resin reinforced with fibrous material (for example, polyester or nylon) is provided over the metal layer.

The light sources in automotive headlamps and other reflector devices can generate a tremendous amount of heat. These devices must meet maintain an operating temperature within the enclosed reflective region (area between the reflector and lens assembly) of no greater than 190° C. Many reflector devices are made from molded plastics that are poor conductors of heat. As a result, heat remains trapped within this reflective area, and temperatures can quickly rise above 190° C. This overheating phenomenon often occurs in underwater flashlights where the entire lighting structure is made of plastic and sealed to prevent infiltration of water.

The industry has attempted to solve these overheating problems by a variety of ways. One process involves molding large milled aluminum heat sinks onto the back of automotive headlamp reflectors. These heat sinks are used often with heat pipes to transfer heat from the back of the reflector to other heat sinks remotely located in the assembly. Another process involves making reflectors from sheets of metal. For example, a sheet of aluminum can be milled or spun into the desired shape of the reflector. However, these manufacturing processes are costly, and it can be cumbersome to produce reflectors having complex shapes using such processes.

There is a need for a thermally conductive lamp reflector that can effectively remove heat from heat-generating lamp assemblies such as automotive headlamps, underwater flashlights, and the like. The present invention provides such a thermally conductive reflector.

SUMMARY OF THE INVENTION

This invention relates to a thermally conductive lamp reflector including a shell having a surface that is coated with a metallized reflective layer. The shell is made from a composition containing a base polymer matrix and thermally conductive filler material. The surface of the shell can be metallized with a layer of aluminum. A protective layer comprising polysiloxane, silicon dioxide, or acrylic resin can be coated over the aluminum-coated layer. The reflector has a thermal conductivity of greater than 3 W/m° K and more preferably greater than 22 W/m° K.

A thermoplastic polymer selected from the group consisting of polycarbonate, polyethylene, polypropylene, acrylics, vinyls, and fluorocarbons can be used to form the matrix. Preferably, a liquid crystal polymer is used. Alternatively, thermosetting polymers such as elastomers, epoxies, polyesters, polyimides, and acrylonitriles can be used. The filler material may be selected from the group consisting of aluminum, alumina, copper, magnesium, brass, carbon, silicon nitride, aluminum nitride, boron nitride, zinc oxide, glass, mica, and graphite. The filler material may be in the form of particles, fibers, or any other suitable form. The polymer matrix preferably constitutes about 30 to about 80% and the thermally conductive filler preferably constitutes about 20 to about 70% by volume of the composition.

In one embodiment, the composition includes: i) about 30 to about 60% by volume of a polymer matrix; ii) about 25 to about 60% by volume of a first thermally conductive filler material having an aspect ratio of 10:1 or greater; and (iii) about 10 to about 15% by volume of a second thermally conductive filler material having an aspect ratio of 5:1 or less.

The present invention also encompasses methods for making thermally conductive lamp reflectors.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description taken in connection with the accompanying drawings in which:

DETAILED DESCRIPTION OF THE PREFERRED EMBODIMENT

Figure 1:
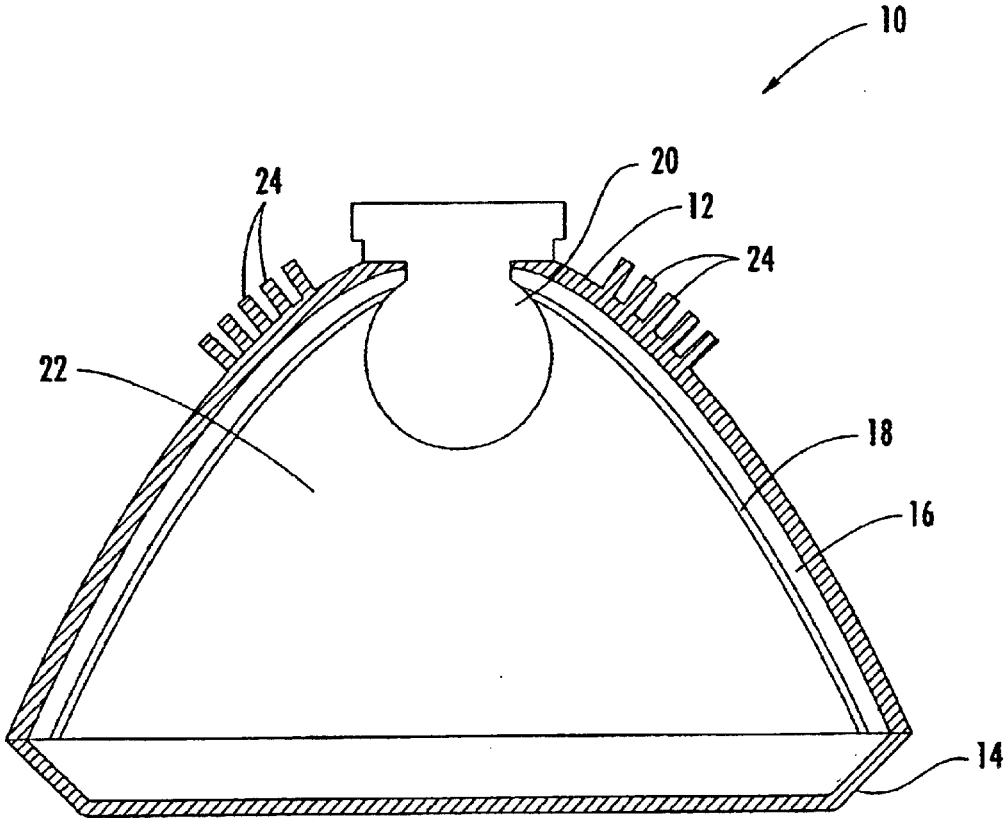
FIG. 1 is a planar cross-sectional view of a lamp reflector of the present invention.

The present invention relates to a thermally conductive lamp reflector and methods for making such reflectors.

A thermally conductive composition is used to make the lamp reflector of this invention. This composition contains a base polymer matrix and thermally conductive filler material. Thermoplastic polymers such as polycarbonate, polyethylene, polypropylene, acrylics, vinyls, and fluorocarbons can be used to form the matrix. Alternatively, thermosetting polymers such as elastomers, epoxies, polyesters, polyimides, and acrylonitriles can be used as the matrix. Suitable elastomers include, for example, styrene-butadiene copolymer, polychloroprene, nitrile rubber, butyl rubber, polysulfide rubber, ethylene-propylene terpolymers, polysiloxanes (silicones), and polyurethanes. Liquid crystal polymers are preferred due to their highly crystalline nature and ability to provide a good matrix for the filler material. Examples of liquid crystalline polymers include thermoplastic aromatic polyesters. Preferably, the polymer matrix constitutes about 30 to about 80% by volume of the composition.

Thermally conductive filler materials are added to the polymer matrix. Suitable filler materials include, for example, aluminum, alumina, copper, magnesium, brass, carbon, silicon nitride, aluminum nitride, boron nitride, zinc oxide, glass, mica, graphite, and the like. Mixtures of such fillers are also suitable. The filler material preferably constitutes about 20 to about 70% by volume of the composition. More preferably, the polymer matrix constitutes greater than 40% and the filler material constitutes less than 60% of the composition. In one embodiment, the polymer matrix is a liquid crystalline polymer constituting about 60% by volume of the composition, and the filler material is PITCH-based carbon fiber constituting about 40% by volume of the composition.

The filler material may be in the form of granular powder, particles, whiskers, fibers, or any other suitable form. The particles can have a variety of structures. For example, the particles can have flake, plate, rice, strand, hexagonal, or spherical-like shapes. The filler material may have a relatively high aspect (length to thickness) ratio of about 10:1 or greater. For example, PITCH-based carbon fiber having an aspect ratio of about 50:1 can be used. Alternatively, the filler material may have a relatively low aspect ratio of about 5:1 or less. For example, boron nitride granular particles having an aspect ratio of about 4:1 can be used. Preferably, both low aspect and high aspect ratio filler materials are added to the polymer matrix as described in McCullough, U.S. Pat. Nos. 6,251,978 and 6,048,919, the disclosures of which are hereby incorporated by reference.

In a preferred embodiment, the polymer composition includes: i) about 30 to about 60% by volume of a polymer matrix; ii) about 25 to about 60% by volume of a first thermally conductive filler material having an aspect ratio of 10:1 or greater; and (iii) about 10 to about 15% by volume of a second thermally conductive filler material having an aspect ratio of 5:1 or less.

More preferably, the composition includes: i) about 50% by volume of a polymer matrix; ii) about 35% by volume of a first thermally conductive filler material having an aspect ratio of at least 10:1; and (iii) about 15% by volume of a second thermally conductive filler material having an aspect ratio of 5:1 or less.

The filler material is intimately mixed with the non-conductive polymer matrix to form the thermally conductive composition. The loading of the filler material imparts thermal conductivity to the polymer composition. If desired, the mixture may contain additives such as antioxidants, plasticizers, non-conductive fillers, stabilizers, dispersing aids, and mold-releasing agents. The mixture can be prepared using techniques known in the art. Preferably, the ingredients are mixed under low shear conditions in order to avoid damaging the structure of the thermally conductive filler materials.

Significantly, the polymer compositions used to make the reflector assemblies of this invention have a thermal conductivity of greater than 3 W/m° K and preferably greater than 22 W/m° K. These heat conduction properties are critical for making an improved lamp reflector that can better dissipate heat from a heat-generating light source.

The polymer composition can be molded into the lamp reflector using a melt-extrusion, injection-molding, casting, or other suitable process. An injection-molding process is particularly preferred. This process generally involve loading pellets of the composition into a hopper. The hopper funnels the pellets into a heated extruder, wherein the pellets are heated and a molten composition (liquid plastic) forms. The extruder feeds the molten composition into a chamber containing an injection piston. The piston forces the molten composition into a mold. (Typically, the mold contains two molding sections that are aligned together in such a way that a molding chamber or cavity is located between the sections.) The material remains in the mold under high pressure until it cools. The shaped reflector is then removed from the mold.

Referring to FIG. 1, one embodiment of the lamp reflector assembly 10 of the present invention is shown. In FIG. 1, a lamp reflector shell 12 is provided with a plastic or glass lens 14 attached thereto. The lamp reflector shell 12 is made from a thermally conductive composition as described above. The surface of the lamp reflector shell 12 can be metallized with a reflective, mirror-like layer 16. Typically, aluminum is used to form the polished reflective layer 16. The metallized surface layer 16 can be formed by spraying liquid metallic aluminum onto the surface of the reflector shell 12 using known vacuum-depositing methods, plating, or any other suitable technique. A protective coating 18 can be applied over the aluminum coated layer. For example, a layer of silicon dioxide or polysiloxane can be vacuum-deposited or acrylic resin can be sprayed onto the coated aluminum layer 16. Also, a light source 20, such as a lamp bulb, is provided within interior chamber 22. In FIG. 1, the lamp reflector shell 12 is shown having a parabolic shape, but it is understood that shell can have a variety of shapes. For example, the shell 12 can have a conical shape.

The lamp reflector shell 12 of the present invention has several advantageous properties. Particularly, the reflector shell 12 has a thermal conductivity of greater than 3 W/m° K, and preferably it is greater than 22 W/m° K. These heat transfer properties allow the reflector to remove heat from interior chamber 22 of the assembly 10, where heat tends to build up quickly. The reflector efficiently dissipates the heat and prevents overheating of this enclosed area. The unique composition of the reflector keeps temperatures within this area below 140° C. and below UL required levels. In addition, the lamp reflector shell 12 may include a number of heat dissipating elements 24 to improve heat transfer by increasing the surface area of the lamp reflector shell 12. The heat dissipating elements 24 are shown in the form of upstanding pins, but they can have other configurations such as fins.

Further, the lamp reflector of this invention is net-shape molded. This means that the final shape of the reflector is determined by the shape of the molding sections. No additional processing or tooling is required to produce the ultimate shape of the reflector. This molding process enables the integration of the heat dissipating elements 24 directly into the lamp reflector shell 12.

The present invention is further illustrated by the following examples, but these examples should not be construed as limiting the scope of the invention.

EXAMPLES

Example 1

A thermally conductive composition including 60% by volume of liquid crystal polymer and 40% by volume of PITCH-based carbon fiber was molded into a parabolic-shaped shell for a lamp reflector. The lamp reflector weighed 2.9 grams. The surface of the lamp reflector was not metallized with a reflective layer. The lamp reflector was equipped with a bulb providing 4.8V and 0.38A. The temperature within the enclosed reflective area was monitored for a period of four (4) hours. The results are identified as reference numeral 1 on the graph of FIG. 2.

Example 2

A thermally conductive composition including 60% by volume of a liquid crystal polymer and 40% by volume of PITCH-based carbon fiber was molded into a solid block and then machined into a conical-shaped shell for a lamp reflector weighing 4.6 grams. The surface of the lamp reflector was not metallized with a reflective layer. The lamp reflector was equipped with a bulb providing 4.8V and 0.38A. The temperature within the enclosed reflective area was monitored for a period of four (4) hours.

Figure 2:
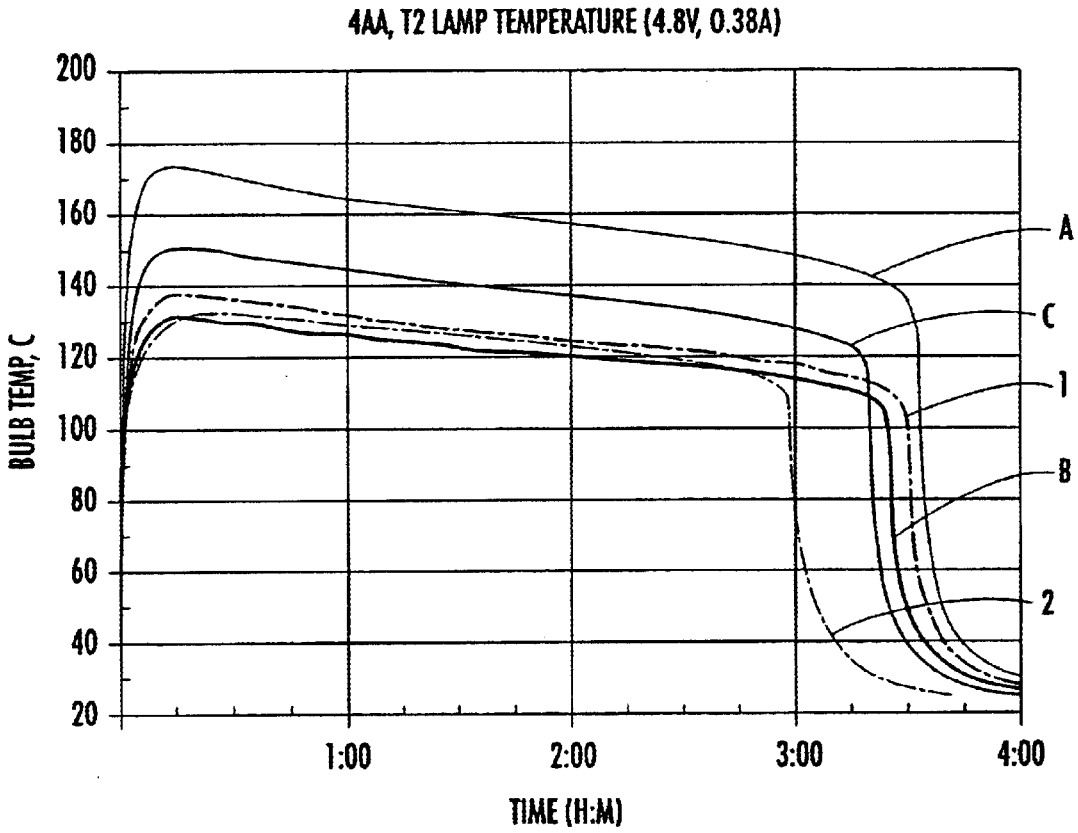
FIG. 2 is a graph showing bulb temperature over time for lamp reflectors of the prior art compared to lamp reflectors of the present invention.

The results are identified as reference numeral 2 on the graph of FIG. 2.

Comparative Example A

A commercially-available existing production lamp reflector made from aluminum was equipped with a bulb providing 4.8V and 0.38A. The surface of the reflector was not metallized with a reflective layer. The temperature within the enclosed reflective area was monitored for a period of four (4) hours. The results are identified as reference letter A on the graph of FIG. 2.

Comparative Example B

A commercially-available prototype lamp reflector having a conical-shaped aluminum shell was equipped with a bulb providing 4.8V and 0.38A. The surface of the aluminum shell was not metallized with a reflective layer or polished. The temperature within the enclosed reflective area was monitored for a period of four (4) hours. The results are identified as reference letter B on the graph of FIG. 2.

Comparative Example C

A thermally conductive composition including 50% by volume aluminum and 50% by volume nylon was molded into a conical-shaped lamp reflector. The surface of the lamp reflector was metallized with aluminum to form a reflective layer. The lamp reflector was equipped with a bulb providing 4.8V and 0.38A. The temperature within the enclosed reflective area was monitored for a period of four (4) hours. The results are identified as reference letter C on the graph of FIG. 2.

In view of the foregoing, an improved lamp assembly 10 is provided having an improved lamp shell 12 with optional heat dissipating elements 24. With the present invention, the temperatures within a lamp assembly can be reduced, thus extending the life of a light source therein.

As shown in the graph of FIG. 2, the lamp reflectors made in accordance with the present invention, as identified by curves 1 and 2, have an improved bulb temperature profile compared to existing production lamp reflectors. Specifically, the overall temperatures for the lamp reflectors of the present invention are lower than temperatures for conventional reflectors. Also, it takes less time for the lamp reflectors of the present invention to cool down.

In addition, other thermally conductive compositions were used to make lamp reflectors in accordance with the present invention as described in the following Examples 3–8. Various particles were used as thermally conductive filler materials in the following examples. The average particle size was about 15 $\mu$m, although particles having a particle size as large as 500 $\mu$m were used at times. In accordance with the present invention, it has been found that particles having a relatively small particle size, for example about 15 $\mu$m, should be used, because these small particles help provide a smoother surface for the lamp reflector. The smooth surface can be plated with a metallized reflective layer. After plating and other secondary operations, the surface remains smooth and does not have any pits or orange peel-like imperfections.

Example 3

A thermally conductive composition including 80% by volume of polycarbonate and 20% by volume of graphite particles having an average particle size of about 15 $\mu$m and density of 2.1 g/cc was molded into a shell for a lamp reflector.

Example 4

A thermally conductive composition including 50% by volume of polycarbonate and 50% by volume of graphite particles having an average particle size of about 15 $\mu$m and density of 2.1 g/cc was molded into a shell for a lamp reflector.

Example 5

A thermally conductive composition including polyester (PET) and alumina particles was prepared. The amount of polyester varied in the range of about 60% to 80% by volume, and the amount of alumina particles varied in the range of about 20% to about 40% by volume. The alumina particles had an average particle size of about 15 $\mu$m and density of 3.9 g/cc. The composition was molded into a shell for a lamp reflector.

Example 6

A thermally conductive composition including polyester (PET) and glass particles was prepared. The amount of polyester varied in the range of about 60% to 80% by volume, and the amount of glass particles varied in the range of about 20% to about 40% by volume. The glass particles had an average particle size of about 15 μm and density of 2.6 g/cc. The composition was molded into a shell for a lamp reflector.

Example 7

A thermally conductive composition including polyester (PET) and mica particles was prepared. The amount of polyester varied in the range of about 60% to 80% by volume, and the amount of mica particles varied in the range of about 20% to about 40% by volume. The mica particles had an average particle size of about 15 μm. The mica particles were used to try and reduce the coefficient of thermal expansion (CTE) of the composition. The composition was molded into a shell for a lamp reflector.

Example 8

A thermally conductive composition including polyester and graphite particles was prepared. The amount of polyester varied in the range of about 60% to 80% by volume, and the amount of graphite particles varied in the range of about 20% to about 40% by volume. The graphite particles had an average particle size of about 15 μm and density of 2.1 g/cc. The composition was molded into a shell for a lamp reflector.

It is appreciated by those skilled in the art that various changes and modifications can be made to the illustrated embodiments without departing from the spirit of the invention. All such modifications and changes are intended to be covered by the appended claims.

What is claimed is:

1. A thermally conductive lamp reflector having a thermal conductivity of greater than 3 W/m° K, comprising:

a shell having a surface; and a metallized layer on the surface of the shell;

said shell including about 30% to about 80% by volume of a liquid crystal polymer matrix and about 20% to about 70% by volume of a thermally conductive PITCH-based carbon fiber.

2. The lamp reflector of claim 1, wherein the metallized layer includes aluminum.

3. The lamp reflector of claim 1, wherein a protective layer including a compound selected from the group consisting of polysiloxanes, acrylics, and silicon dioxide is coated over the metallized layer.

4. A thermally conductive lamp reflector having a thermal conductivity of greater than 3 W/m° K, comprising:

a shell having a surface; and a metallized layer on the surface of the shell;

said shell including: i) about 30% to about 60% by volume of a liquid crystal polymer matrix, ii) about 25% to about 60% by volume of a first thermally conductive filter material having an aspect ratio of 10:1 or greater, and iii) about 10% to about 15% by volume of a second thermally conductive filler material having an aspect ratio of 5:1 or less, wherein the first thermally conductive material is PITCH-based carbon fiber.

5. The lamp reflector of claim 4, wherein the reflector has a thermal conductivity of greater than 22 W/m° K.

6. The lamp reflector of claim 4, wherein the metallized layer includes aluminum.

7. The lamp reflector of claim 4, wherein the first thermally conductive filler material includes carbon fiber having an aspect ratio of about 50:1, and the second thermally conductive filler material includes boron nitride particles having an aspect ratio of about 4:1.

8. A method of forming a thermally conductive lamp reflector having a thermal conductivity of greater than 3 W/m° K, comprising the steps of:

molding a shell, having an inner surface, said shell including about 30% to about 80% by volume of a liquid crystal polymer matrix and about 20% to about 70% by volume of a thermally conductive PITCH-based carbon fiber; and depositing a layer of metallized material on the inner surface of the shell.

9. The method of claim 8, wherein the metallized material is aluminum.

10. The method of claim 8, wherein a protective layer including a compound selected from the group consisting of polysiloxanes, acrylics, and silicon dioxide is coated over the metallized layer.

* * * * *